US007766310B2

(12) United States Patent
Wolff et al.

(10) Patent No.: US 7,766,310 B2
(45) Date of Patent: Aug. 3, 2010

(54) HUMIDIFIER WITH WATER TANK QUICK ASSEMBLY FEATURE

(75) Inventors: Steven L. Wolff, Hamel, MN (US); Wayne R. Anderson, Eden Prairie, MN (US); Josef Novotny, Kuncina (CZ)

(73) Assignee: Honeywell International Inc., Morristown, NJ (US)

( * ) Notice: Subject to any disclaimer, the term of this patent is extended or adjusted under 35 U.S.C. 154(b) by 316 days.

(21) Appl. No.: 11/873,783

(22) Filed: Oct. 17, 2007

(65) Prior Publication Data

US 2009/0102076 A1 Apr. 23, 2009

(51) Int. Cl.
*B01F 3/04* (2006.01)

(52) U.S. Cl. ..... 261/72.1; 261/119.1; 261/DIG. 10; 261/DIG. 76

(58) Field of Classification Search ..... 261/72.1, 261/115, 118, 119.1, 141, 142, DIG. 10, 261/DIG. 15, DIG. 65, DIG. 76
See application file for complete search history.

(56) References Cited

U.S. PATENT DOCUMENTS 3,689,037 A * 9/1972 Payne ..... 261/105
3,855,371 A * 12/1974 Morrow et al. ..... 261/100
3,898,976 A * 8/1975 Coffman, Jr. ..... 126/113
4,211,735 A * 7/1980 Berlin ..... 261/116
5,406,673 A 4/1995 Bradd et al.
6,286,181 B1 9/2001 Kasper et al.
2004/0084787 A1* 5/2004 Williams et al. ..... 261/72.1
2005/0150491 A1* 7/2005 Chen ..... 128/203.16

OTHER PUBLICATIONS

"Bissell ProHeat Pro-Tech User's Guide", *7920 / 7901 Series 8915/ 8910 Series* Jul. 2003 , pp. 1-24.

* cited by examiner

*Primary Examiner*—Scott Bushey
(74) *Attorney, Agent, or Firm*—Crompton Seager & Tufte LLC

(57) ABSTRACT

A steam humidifier having a water tank with a quick assembly feature. The steam humidifier includes a removable tank, where the removable tank is configured to contain water to be heated to generate steam and a handle that is configured to selectively secure the removable tank to the humidifier. The handle defines at least a first rotational position in which a tank support feature on the tank is engaged with a handle support feature on the handle such that the tank is attached to the humidifier. The handle further defines at least a second rotational position in which the tank support feature is disengaged from the handle support feature such that the tank is unattached from the humidifier. Additional embodiments are disclosed.

21 Claims, 12 Drawing Sheets

HUMIDIFIER WITH WATER TANK QUICK ASSEMBLY FEATURE

FIELD OF THE INVENTION

The invention relates to steam humidifiers, and more particularly, to constructions for a tank of a steam humidifier.

BACKGROUND OF THE INVENTION

The interior spaces of buildings are often at a lower than desired level of humidity. This situation occurs commonly in arid climates and during the heating season in cold climates. There are also instances in which special requirements exist for the humidity of interior spaces, such as in an art gallery or where other delicate items are stored, where it is desired that the interior humidity levels be increased above naturally occurring levels. Therefore, humidifier systems are often installed in buildings to increase the humidity of an interior space.

Humidification systems may take the form of free-standing units located within individual rooms of a building. More preferably, humidification systems are used with building heating, ventilation, and air conditioning (HVAC) systems to increase the humidity of air within ducts that is being supplied to interior building spaces. In this way, humidity can be added to the air stream at a centralized location, as opposed to having multiple devices that increase humidity at multiple points within the building interior. Additionally, because the air within ducts may be warmer than the interior space air during a heating cycle, the additional air temperature can help prevent water vapor from condensing in the vicinity of the humidifier, such as on the inside of the duct.

An issue associated with humidification system is that they should only discharge water vapor into a duct and not liquid water. Liquid water within a duct can create a number of serious problems. For example, liquid water that remains stagnant within a duct can promote the growth of mold or organisms that can release harmful substances into the air flow, potentially causing unhealthy conditions in the building. Liquid water can also cause rusting of a duct which can lead to duct failure, and can create leaks from the duct to the building interior spaces which are unsightly, can cause a slipping hazard, and can lead to water damage to the structure.

One known humidification method involves direct steam injection into an air duct of a building. This approach is most commonly used in commercial buildings where a steam boiler is present to provide a ready supply of pressurized steam. Steam humidification has the advantage of having a relatively low risk of liquid moisture entering a duct or other building space. However, pressurized steam injection systems are associated with a risk of explosion of the steam pressure vessels, as well as a risk of possibly burning nearby people, both of which are very serious safety concerns. In residential applications, there are usually no readily available sources of pressurized steam. An open bath humidifier system may be used, however these are difficult to install because they require a large hole in the duct and can only be used with horizontal or upflow ducts. Alternatively, a residential application may use direct steam injection that requires a separate unit to generate pressurized steam and this separate unit is costly. Moreover, the system would suffer from the same disadvantages as are present in commercial direct steam injection systems.

One type of humidifier that is commonly used in residential applications that has the advantages of steam humidification without the need for a separate source of pressurized steam is a tank heater type humidifier that generates steam with little or no pressure. In this type of humidifier, heat is generated within a tank of water, causing the water to boil and steam to be generated. The heat input may be any of a number of different sources, however, commonly an electrical heating element is used. One problem associated with this type of humidifier is that as water is boiled off as steam, the impurities in the water remain in the tank. These impurities generally include minerals that are naturally occurring in most sources of water. Over time, the concentration of these impurities will tend to increase in the tank, leading to greater amounts of impurities that solidify and deposit on the surfaces inside the tank. These deposits can accumulate to the point of creating numerous problems. For example, deposits on a heating coil reduce the heat transfer rate to the water, resulting in lower steam production and possibly causing overheating and failure of the coil. Deposits in the tank can clog passages where water or steam flows in or out, resulting in the failure of the humidifier. It is therefore necessary for a user of a humidifier to occasionally remove the tank of the humidifier and manually clean the tank and associated components to remove the deposits and accumulations.

Improved constructions for humidification systems are desired. In particular, improved constructions for water tanks of steam humidifiers are needed, and specifically, constructions that permit the tank to be readily removed for cleaning.

SUMMARY OF THE INVENTION

The present disclosure relates to a water tank quick assembly feature for a steam humidifier. In one aspect of the invention, a steam humidifier is disclosed. The steam humidifier includes a removable tank, where the removable tank is configured to contain water to be heated to generate steam and a handle that is configured to selectively secure the removable tank to the humidifier. The handle defines at least a first rotational position in which a tank support feature on the tank is engaged with a handle support feature on the handle such that the tank is attached to the humidifier. The handle further defines at least a second rotational position in which the tank support feature is disengaged from the handle support feature such that the tank is unattached from the humidifier.

Another aspect of the invention relates to a steam humidifier having a main structure that is configured to be attached to a building structure and a tank for containing water and a heating element for heating the water in the tank to generate steam. The tank includes an upper structure that is secured to the main structure, a lower structure that is configured to mate with the upper structure to form an enclosed volume of the tank, a pair of tank pivot points located on the upper structure, and a pair of tank arc structures on the lower structure, where each tank arc structure is proximate to each pivot point. The steam humidifier further includes a handle having a pair of handle pivot points that are configured to engage the tank pivot points and that have a pair of handle arc structures configured to be engageable with the tank arc structures. The handle has at least a first rotational position in which the handle arc structures are engaged with the tank arc structures such that the tank lower structure is supported by the main structure, and a second rotational position in which the handle arc structures are disengaged from the tank arc structures such that the tank lower structure is free from the main structure.

An additional aspect of the invention relates to a method of removing a tank from a steam humidifier. The method includes rotating a handle from a first position to a second position, where in the first position a support feature on the tank is engaged with a support feature on the handle such that the tank is attached to the steam humidifier, and in the second position the support feature on the tank is disengaged from the support feature on the handle such that the tank is unattached from the humidifier. The method further includes separating the tank from the humidifier.

The invention may be more completely understood by considering the detailed description of various embodiments of the invention that follows in connection with the accompanying drawings.

Figure 1:
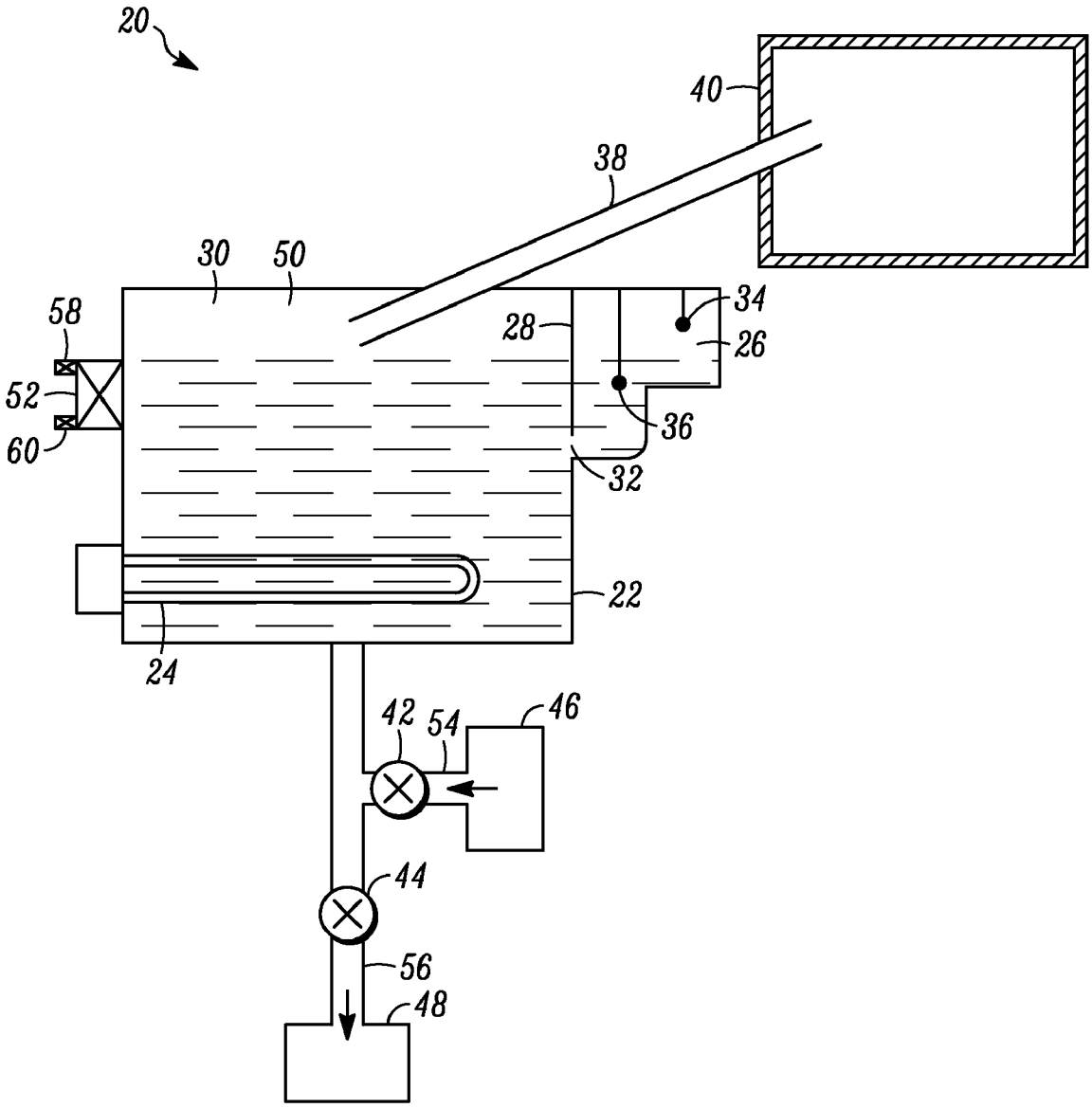
FIG. 1 is a cross-sectional view of a tank heater type steam humidifier.

While the invention may be modified in many ways, specifics have been shown by way of example in the drawings and will be described in detail. It should be understood, however, that the intention is not to limit the invention to the particular embodiments described. On the contrary, the intention is to cover all modifications, equivalents, and alternatives following within the scope and spirit of the invention as defined by the claims.

DETAILED DESCRIPTION OF THE INVENTION

As described above, minerals, sediments, and other impurities present in water tend to deposit in the tank of a tank heater type humidifier over the course of its operation. These deposits can build up and cause damage and interfere with the proper functioning of the humidifier. The rate at which these deposits form depend on a number of variables, including the mineral content of the water (hardness) and the amount of time that the humidifier is operated. It is generally recommended or required that the user of a humidifier disassemble and manually clean the tank and associated parts at a regular interval, such as every year. In some cases, a humidifier may provide an indication to the user that the tank needs to be cleaned. If the tank is not cleaned, deposits can accumulate to the point of clogging the drain, either reducing the efficiency of the drain or preventing the tank from draining all together. It is therefore desirable that the user of a humidifier remove the tank at regular intervals and manually clean it to remove the deposits and accumulations.

An embodiment of a tank heater type humidifier is depicted schematically in FIG. 1. Humidifier 20 includes a tank 22 configured to retain a volume of liquid water. Tank 22 is generally constructed out of material that is sufficiently resistant to high temperatures, such as the temperature of boiling water. Examples of suitable materials for tank 22 are temperature resistant plastics, an example of which is a thermoplastic resin such as a polyphenylene ether/polystyrene blend, and stainless steel. In one embodiment, components of tank 22 are formed by injection molding. A heating coil 24 is also provided to heat water within tank 22. Heating coil 24 is generally an electric heating coil that generates heat when an electric current is passed through a resistive material. However, other types of heating coils 24 are usable. For example, heating coil 24 could pass a heated material such as a heated liquid through a tube that allows heat to transfer to the liquid in the tank 22. Furthermore, a heater may be substituted for heating coil 24, where a heater is of a conventional liquid heating design, such as a propane or natural gas liquid heater or a fuel oil burner.

Tank 22 is shown in FIG. 1 as having an isolated chamber 26 that is separated from a main chamber 30 of tank 22 by baffle 28. Isolated chamber 26 is in fluid communication with main chamber 30 by way of opening 32 which allows liquid from main chamber 30 to flow into isolated chamber 26 and to reach the same fluid level as in main chamber 30. Isolated chamber 26 tends, however, to be insulated from ripples, bubbles, and other fluctuations of the water level in main chamber 30, and therefore is a suitable location for measuring the water level in tank 22. FIG. 1 also shows that a high level water sensor 34 and a low level water sensor 36 are present within isolated chamber 26. Low level sensor 36 detects the presence of water at a first level and high level sensor 34 detects the presence of water at a second level, where the first level is lower than the second level. Each of sensors 34, 36 is configured to detect the presence of water at the particular sensor. Sensors 34, 36 may be a current-detection type of sensor, where a source of current such as alternating current is applied at a point in the tank that is below both sensors 34, 36 and where sensors 34, 36 are configured to detect the presence of current which indicates a current path from the source of current, through the water, to sensors 34, 36. Humidifier 20 further includes a tube 38 that projects from main tank chamber 30 to the interior of an air duct 40 and that provides a fluid connection for the flow of steam from main tank chamber 30 to the interior of air duct 40.

Humidifier 20 includes a fill valve 42 and a drain valve 44. Fill valve 42 is in fluid communication through conduit 54 with a water supply 46, such as a municipal water supply system or a well pump system. Drain valve 44 is in fluid communication through a conduit 56 with a water receiving system 48, such as a municipal water treatment system, a septic system, or a drain field. Humidifier 20 further includes a controller 52 that is in communication with water level sensors 34, 36 and has the ability to control the fill and drain valves 42, 44. Controller 52 also includes one or more timers configured to measure elapsed times.

Figure 2:
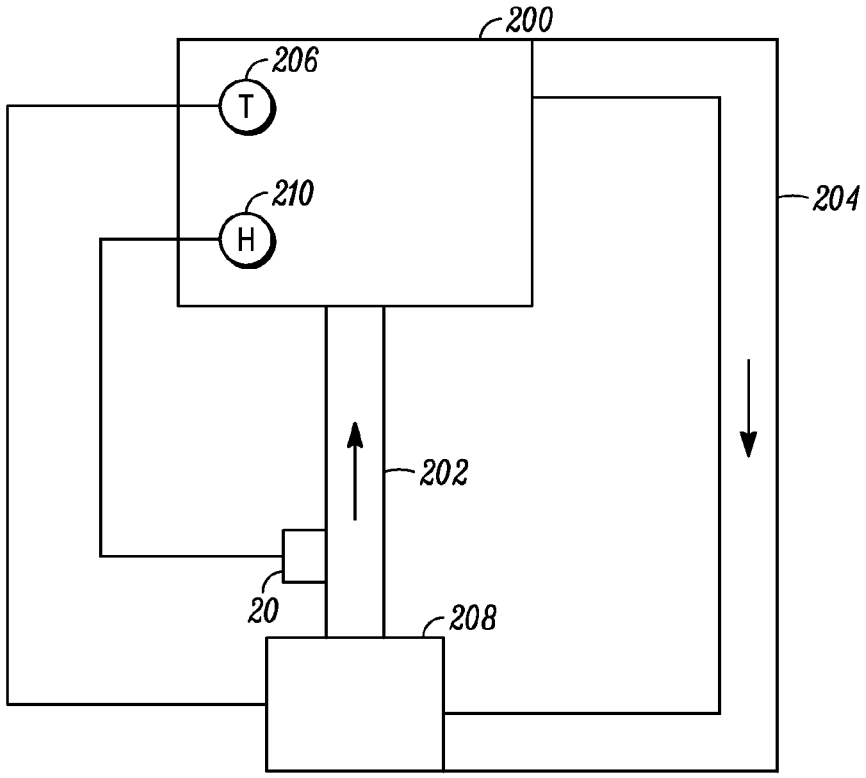
FIG. 2 is a schematic representation of a HVAC system having a humidifier.

A typical heating, ventilation, and air conditioning (HVAC) installation that includes a humidifier is depicted in FIG. 2. Conditioned space 200 of a building is configured to receive conditioned air from supply duct 202 and to provide for return air flow through return duct 204. Conditioned space 200 includes at least one thermostat 206 that is in communication with conditioning device 208. Conditioning device 208 may be a furnace, a boiler, an air conditioner, a heat exchanger, or a combination thereof, that is configured to condition return air from return duct 204 and deliver the conditioned air to supply duct 202. Conditioning air may involve increasing the temperature of the air, decreasing the temperature of the air, cleaning the air, or other such processes. Conditioning device 208 generally includes a fan or blower for drawing air from return duct 204 and delivering air through supply duct 202. Thermostat 206 senses the temperature in conditioned space 200 and activates conditioning device 208 when the temperature deviates from a set value. When conditioning device 208 is activated by a call for conditioning from thermostat 206, conditioned air is supplied through supply duct 202 to adjust the temperature of conditioned space 200 until the temperature sensed by thermostat 206 satisfies a set value. In some embodiments, thermostat 206 may be configured to receive an input to run a fan or blower without temperature conditioning of the air. In this case only the fan or blower portion of conditioning device 208 is activated and air is supplied through supply duct 202 without being conditioned by conditioning device 208.

FIG. 2 also shows a typical installation of humidifier 20. Humidifier 20 is installed on supply duct 202 downstream of conditioning device 208. A humidistat 210 is installed in conditioned space 200 or within return duct 204 and is in communication with humidifier 20. One embodiment of a humidistat 210 senses the relative humidity level (RH) present in conditioned space 200 and activates humidifier 20 when the humidity level falls below a set value. Other embodiments of humidistat 210 sense indoor dewpoint or even outdoor dewpoint in combination with either indoor RH or indoor dewpoint. In some embodiments, the thermostat 206 will incorporate the functionality of humidistat 210. When humidifier 20 is activated, humidity is added to conditioned air within supply duct 202 in order to increase the humidity in conditioned space 200. In some embodiments, humidifier 20 and/or humidistat 210 are configured to activate humidifier 20 only when conditioning device 208 is activated. This ensures that air is flowing through supply duct 202 to carry the additional humidity to conditioned space 200. If humidifier 20 is activated without air flowing in supply duct 202, the additional humidity provided by the humidifier may condense on the walls of the duct and cause damage, and the additional humidity will also not be effectively delivered to conditioned space 200. In other embodiments, the conditioning device 208 will be activated any time there is a demand for humidification from humidistat 210.

In operation of humidifier 20, as can be understood from FIG. 1, when there is a call for humidification, humidifier 20 is filled by opening fill valve 42 to allow water from supply 46 to flow through conduit 54 into main chamber 30 of tank 22 and to isolated chamber 26. Fill valve 42 will remain open until water is detected at high water sensor 34, at which point fill valve 42 is closed. In some embodiments, an overfull sensor is provided to detect water above the high water sensor 34, in which case the fill valve 42 would also be closed if water is detected. This feature is useful in the event of a failure of the high level sensor 34. Heating coil 24 is then energized, causing the temperature of the water in tank 22 to increase. In some embodiments, water tank 22 is filled prior to there being a demand for humidification, such as at installation or system start-up, and the system then waits for a call for humidification to energize the heating coil 24. As the water in tank 22 is heated, the water in tank 22 will begin to boil and steam will form at the top 50 of tank 22. In some embodiments, a very slight pressure will be established in the top area 50 of tank 22, driving steam through tube 38 and into duct 40. Tube 38 is configured to allow sufficient steam to flow into duct 40 that very little pressure will build in tank 22. In other embodiments, no pressure builds in tank 22 and steam is carried by convection into duct 40. The steam enters the air in duct 40 where it is carried to conditioned spaces within a building. As water is converted to steam, the water level in tank 22 will decrease. With sufficient operation, the water level will drop below the height of low water level sensor 36. When water falls below the height of low level sensor 36, fill valve 42 will be opened and remain open until water reaches high level sensor 34, at which point fill valve 42 will again be closed.

Figure 3:
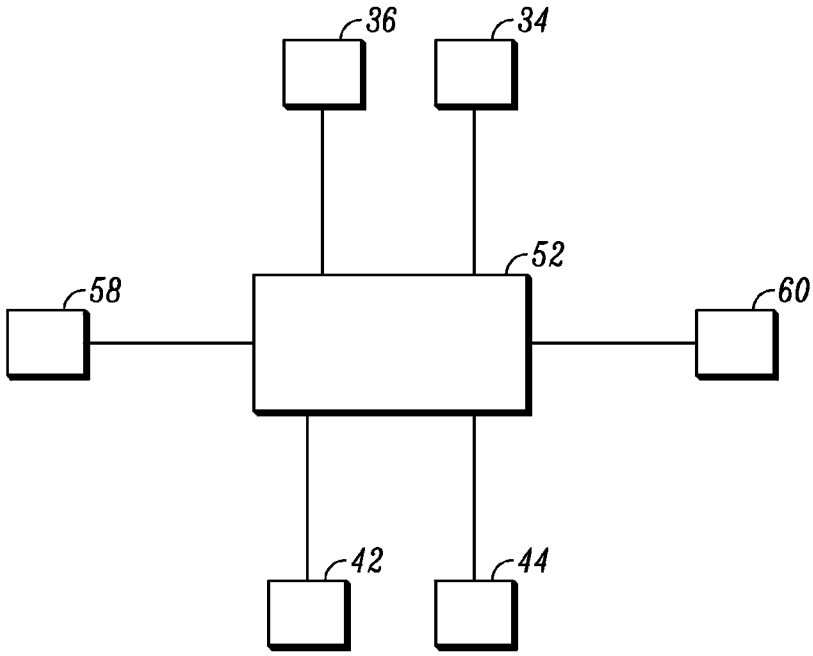
FIG. 3 is a schematic representation of a control system of a humidifier.

An embodiment of the components of a control system of humidifier 20 is depicted in FIG. 3. As shown in FIG. 3, controller 52 is in communication with high level sensor 34 and low level sensor 36. Controller 52 therefore receives signals representative of whether the water level in tank 22 is at or above low level sensor 36 and whether the water level in the tank 22 is at or above high level sensor 34. Controller 52 is further in communication with fill valve 42 and drain valve 44, and is able to control the operation of each. Controller 52 is also shown in FIG. 3 as being in communication with indicator 58. Indicator 58 may be used to communicate information to a user, such as the need to clean the tank. Controller 52 also has an input device 60, such as a switch or button or touch screen configured to receive input from a user, such as to indicate that the humidifier has been cleaned.

Figure 4:
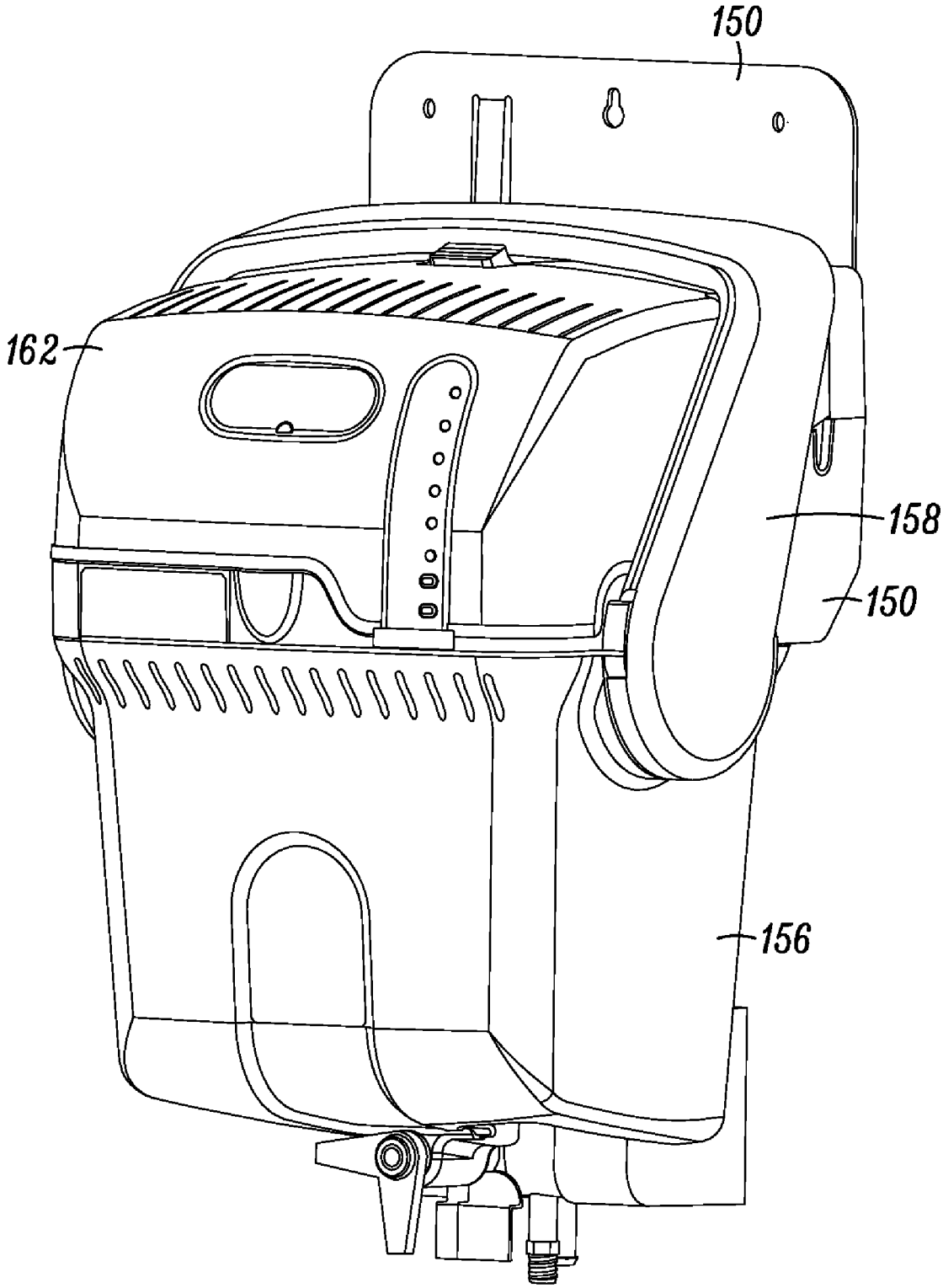
FIG. 4 is a front side perspective view of a humidifier having a water tank with a quick connection feature constructed according to the principles of the present invention.

FIG. 4 is a front and side perspective view of a humidifier having a tank with a quick connection feature that allows the tank to be removed for cleaning in an expedient manner and without requiring the use of special tools or training. This arrangement is particularly advantageous because the typical humidifier user who has to remove the tank for cleaning is a homeowner or other person who does not have special training, may not want to spend much time learning how to perform a complicated procedure to remove a tank, and may not have ready access to tools for removing the tank. The tank quick connection feature is relatively easy to use because the user can, with one hand, support the tank, and with the other hand, rotate the handle to cause the tank to be released from the humidifier.

Figure 11:
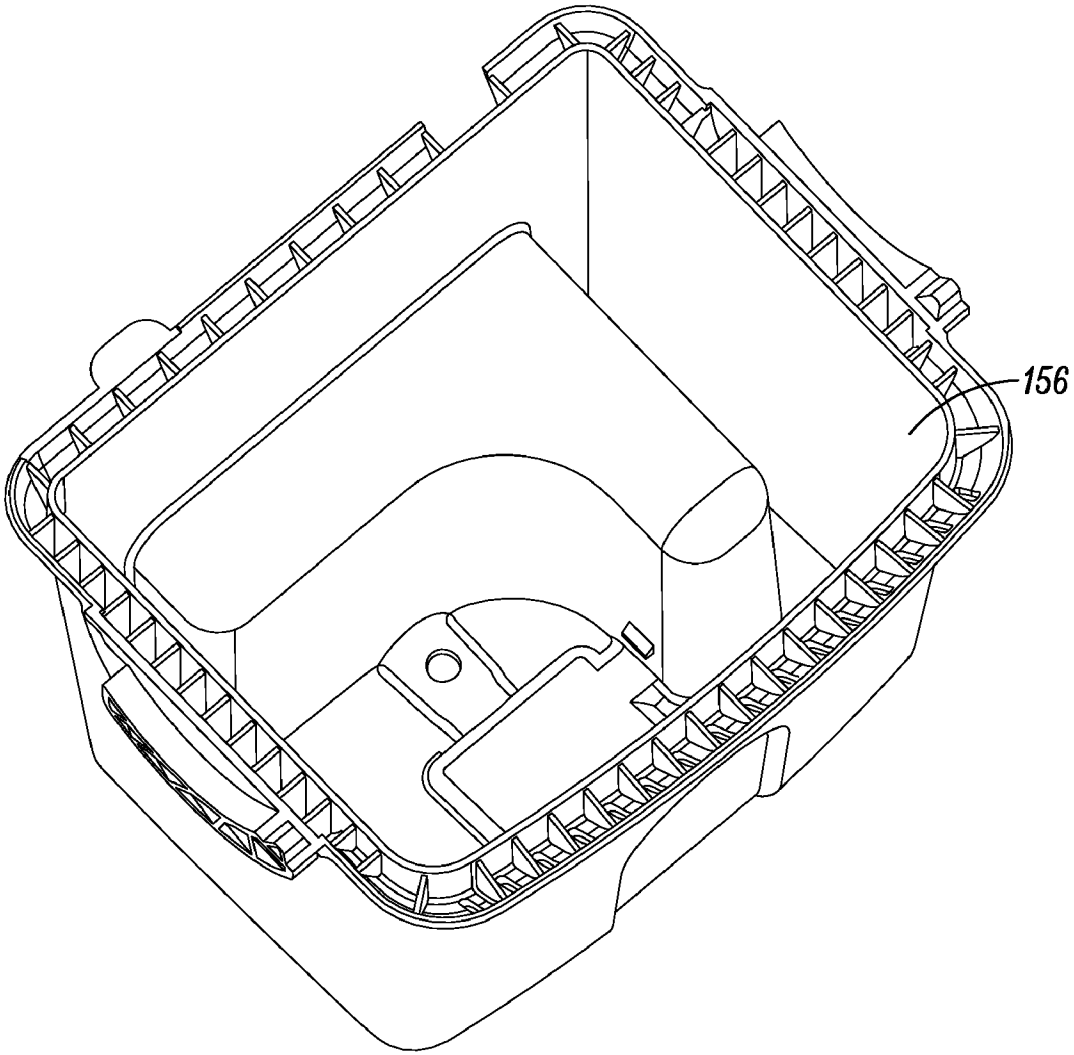
FIG. 11 is a top perspective view of an open top container.
Figure 12:
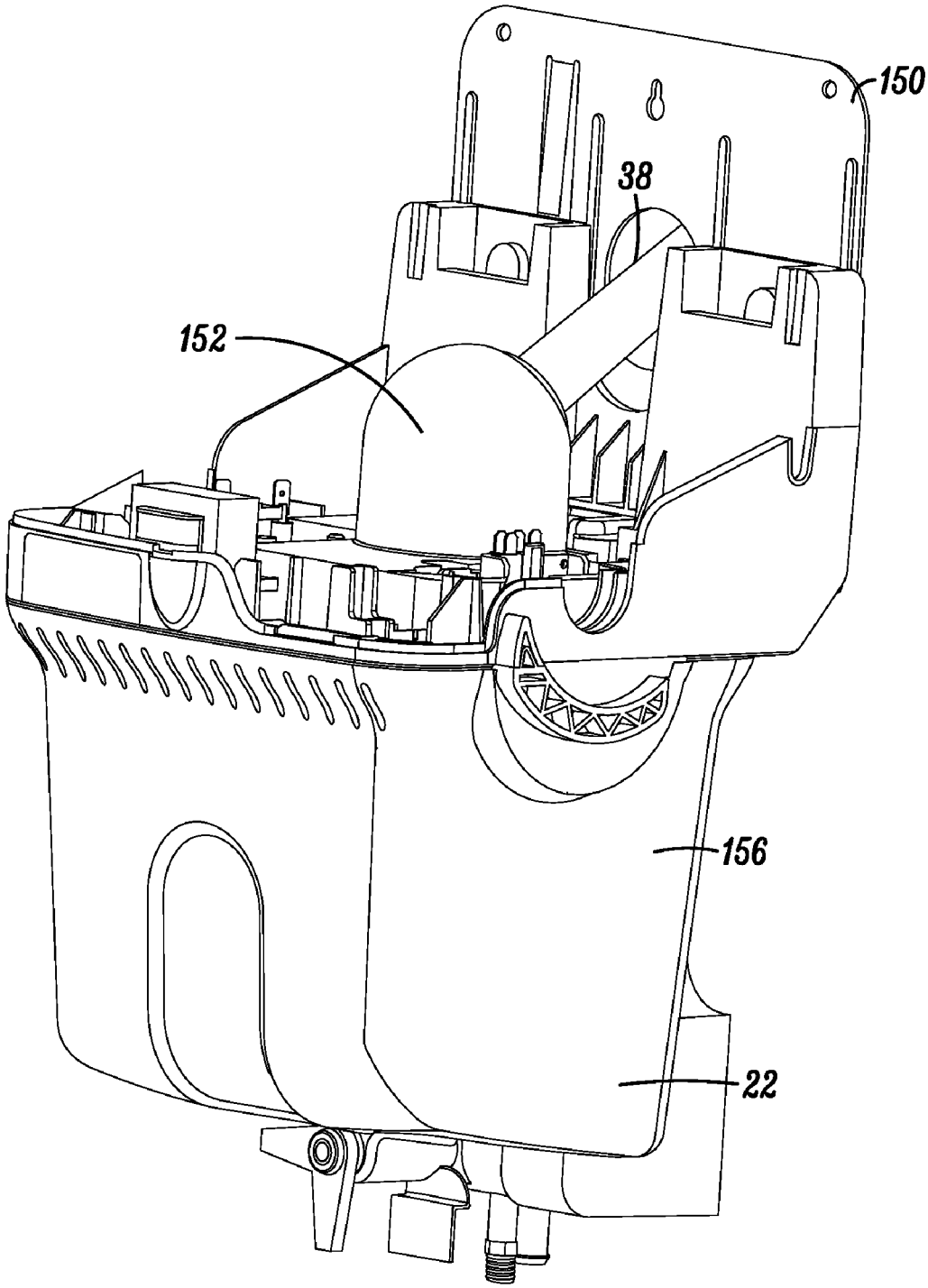
FIG. 12 is a side perspective view of a humidifier having a cover removed to show a steam tube and steam dome.

The humidifier 20 depicted in FIG. 4 includes a main structure 150 that is configured to be mounted to a duct or other attachment point within a building. Main structure 150 may consist of a single piece or may be formed from several pieces that are attached or secured or structurally connected to each other. In one embodiment, main structure 150 is formed by injection molding. In another embodiment, main structure 150 is formed by several injection molded components that are configured to interact to provide a support structure. As shown in FIG. 12, main structure 150 also includes a structure for receiving steam tube 38, such as a steam dome 152, such that steam tube 38 is in fluid communication with tank 22. Tank 22 is partially defined by main structure 150 that forms an upper boundary of tank 22, and the remainder of tank 22 is defined by open top container 156. Open top container 156 is assembled to main structure 150 to form a watertight and steamtight enclosed volume that constitutes tank 22. For example, a seal such as an o-ring seal may be provided between open top container 156 and main structure 150 to form a watertight and steam tight enclosed volume. A top perspective view of open top container 156 is shown in FIG. 11. In some embodiments, open top container 156 is formed by injection molding.

Figure 5:
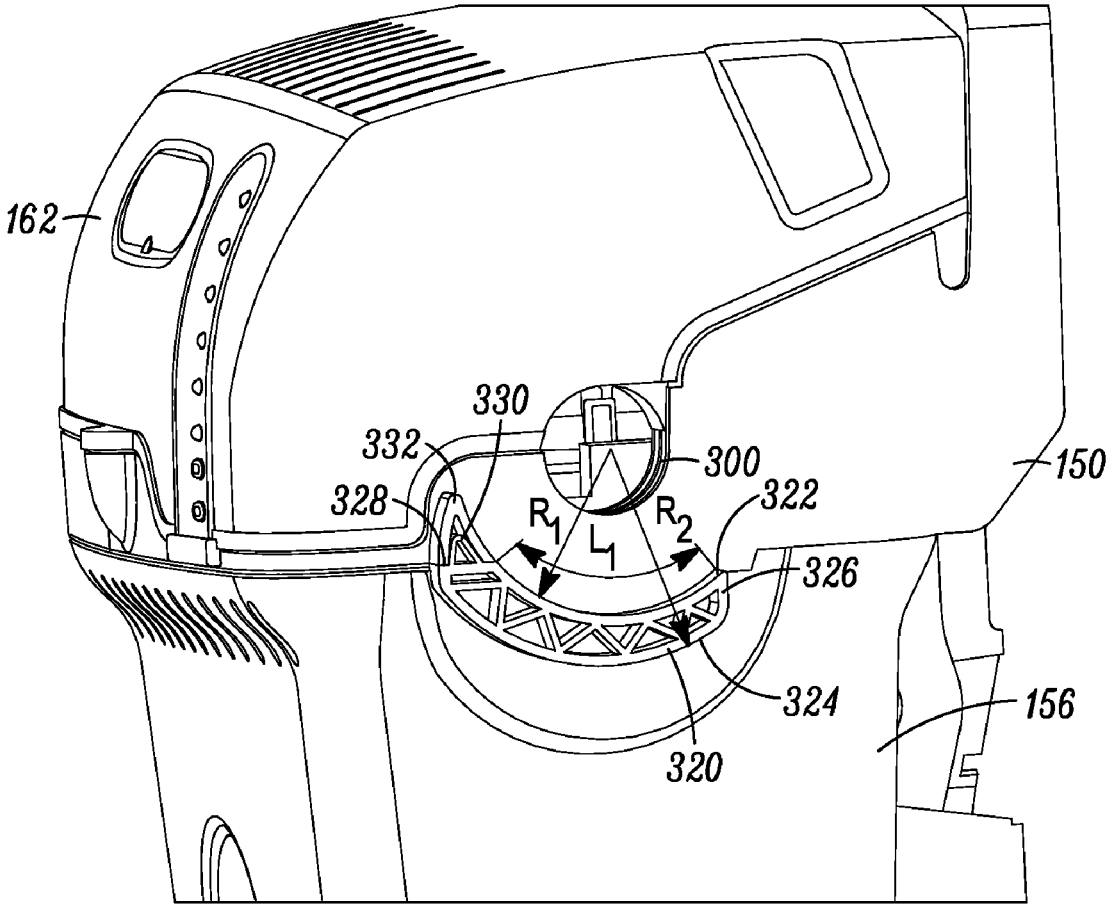
FIG. 5 is a side perspective view of the humidifier of FIG. 4 with the handle removed to show details of the construction of a tank support feature of the quick connection feature.
Figure 13:
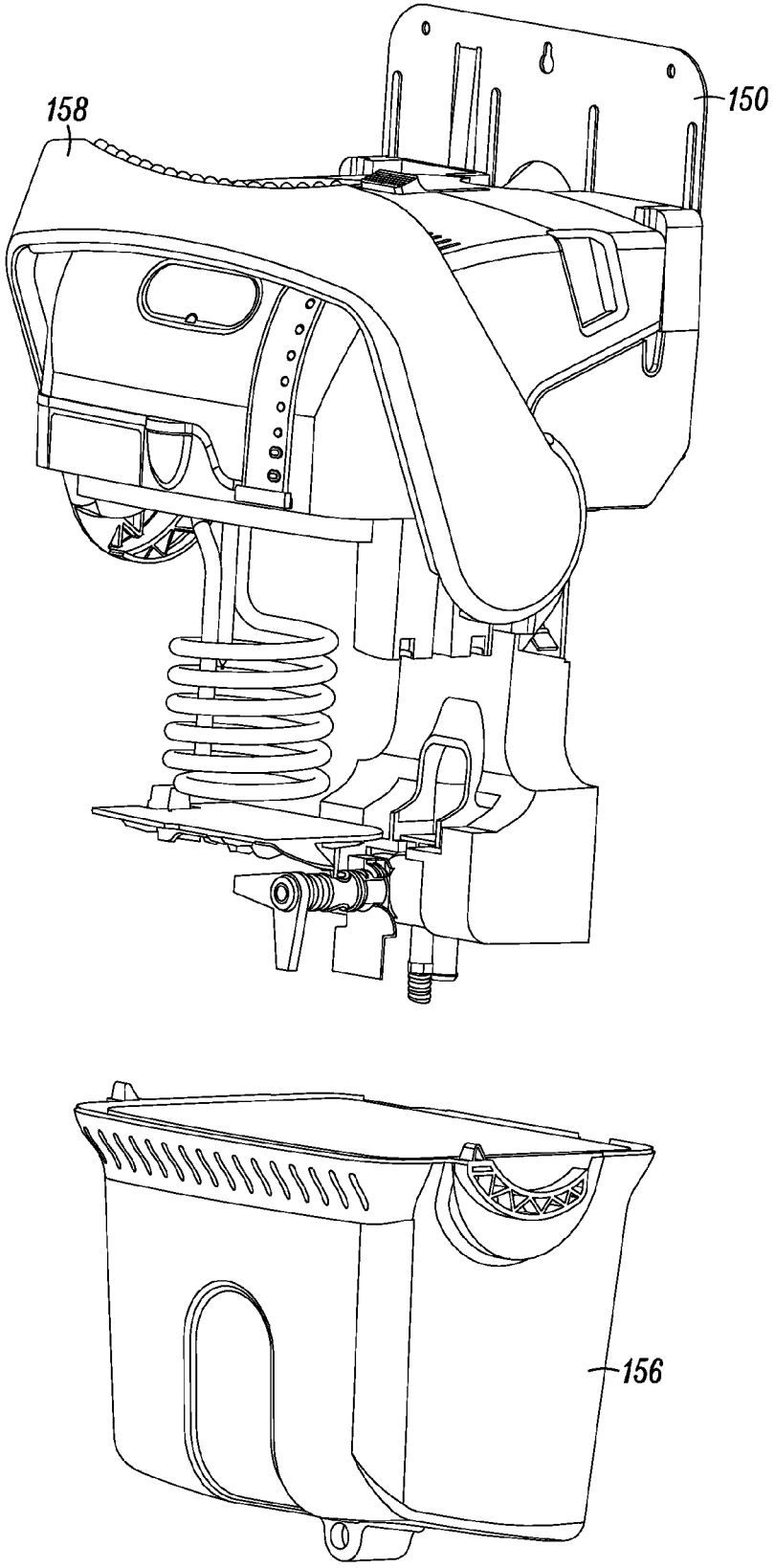
FIG. 13 is an exploded perspective view of an open top container removed from a humidifier with the handle in an unlocked position.

The quick connection feature of tank 22 allows the tank to be readily removed and serviced. The connection of the open top container 156 to the main structure 150 is controlled by the position of handle 158. When handle 158 is in the position shown in FIG. 4, open top container 156 is held securely against main structure 150. In this case, handle 158 is said to be in the closed or locked position. A perspective view of the interface between open top container 156 and main structure 150 is shown in FIG. 5, where the handle is not shown. A seal is placed between open top container 156 and main structure 150 and is compressed by the force applied by handle 158 to create the watertight and steamtight enclosure that constitutes tank 22. FIG. 13 shows a view of handle 158 in the open or unlocked position. In this position, open top container 156 can be removed from main structure 150, such as for cleaning.

Figure 7:
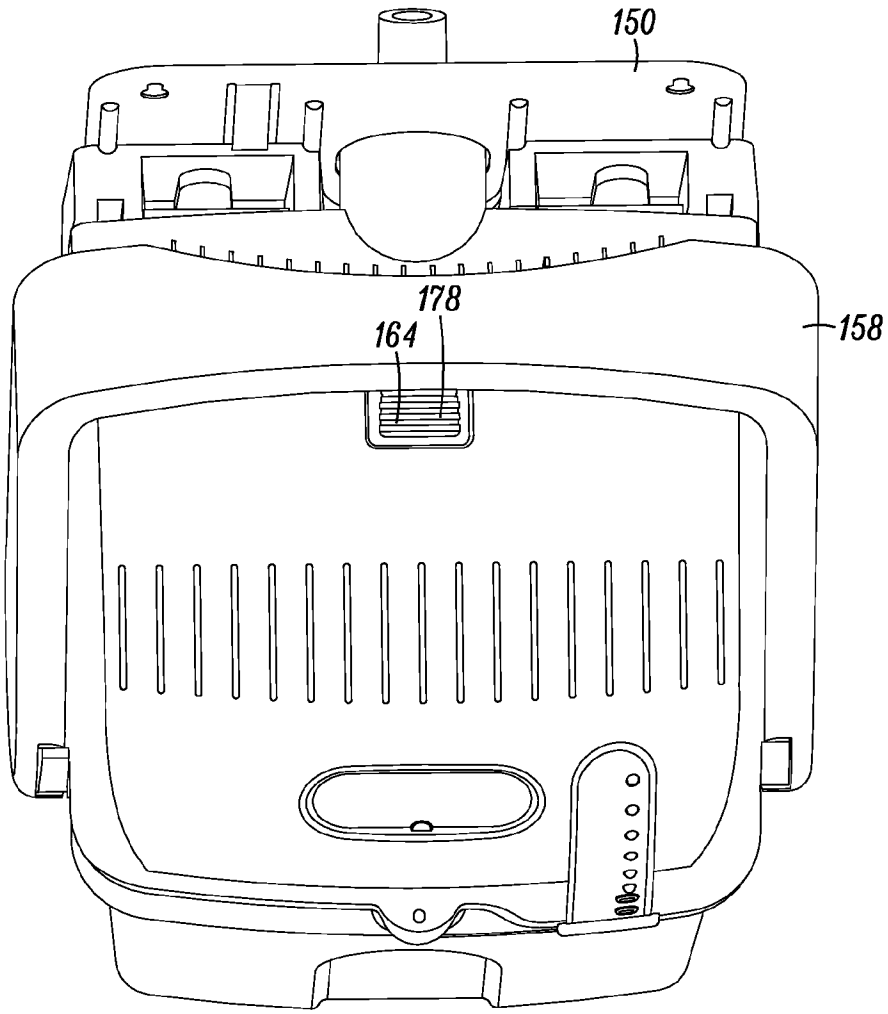
FIG. 7 is a top perspective view of a humidifier having a handle and a handle locking feature.

A portion of main structure 150 is formed by upper cover 162. Upper cover 162 serves to hide from view and protect various functional components that are mounted to main structure 150. For example, there may be valves, relays, electronic controls, and wiring that are hidden and protected by upper cover 162. FIG. 12 shows humidifier 20 with upper cover 162 and handle 158 removed. As seen in FIG. 7, a locking button 164 is incorporated into or attached to upper cover 162. Locking button 164, also called a locking tab 164, serves to secure handle 158 in the closed or locked position. Because handle 158 controls whether open top container 156 is secured to main structure 150, and because during normal operation open top container 156 contains boiling water, it is desirable to have a feature such as locking button 164 to prevent handle 158 from inadvertently being unlocked and releasing open top container 156.

Figure 8:
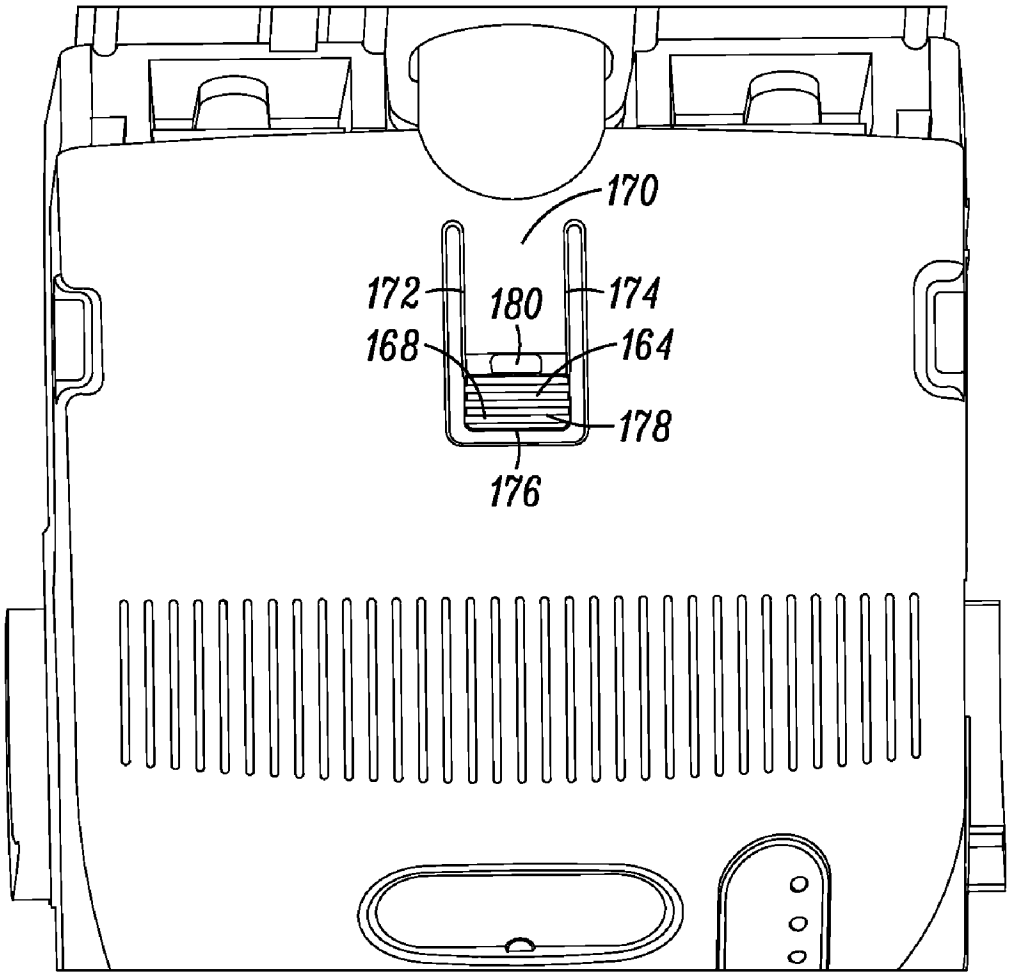
FIG. 8 is a top view of the humidifier of FIG. 7 with the handle removed to show details of the handle locking feature.

Locking button 164 is also shown in FIG. 8, with handle 158 removed for clarity. In the depicted embodiment, locking button 164 includes a cantilevered section 168 that is attached at an end 170 to upper cover 162 and that is separated from upper cover 162 along sides 172, 174, 176. Proximal to side 176 is a serrated protrusion 178. Cantilevered section 168 is constructed from a material and with a thickness that it is capable of flexing, such as when a force is applied to serrated protrusion 178 by a person's finger. When handle 158 is in the locked position, as shown in FIG. 7, locking protrusion 182 on handle 158 engages notch 180 on button 164. In this position, handle 158 cannot be rotated forward to unlock open top container 156 because it is secured in place by notch 180. However, when it is desired to release open top container 156, the user presses downward on serrated protrusion 178 to cause cantilevered section 168 to flex and be forced downward, causing notch 180 to be moved below protrusion 182 allowing movement of handle 158. Handle 158 can then be rotated forward to release open top container 156.

Figure 6:
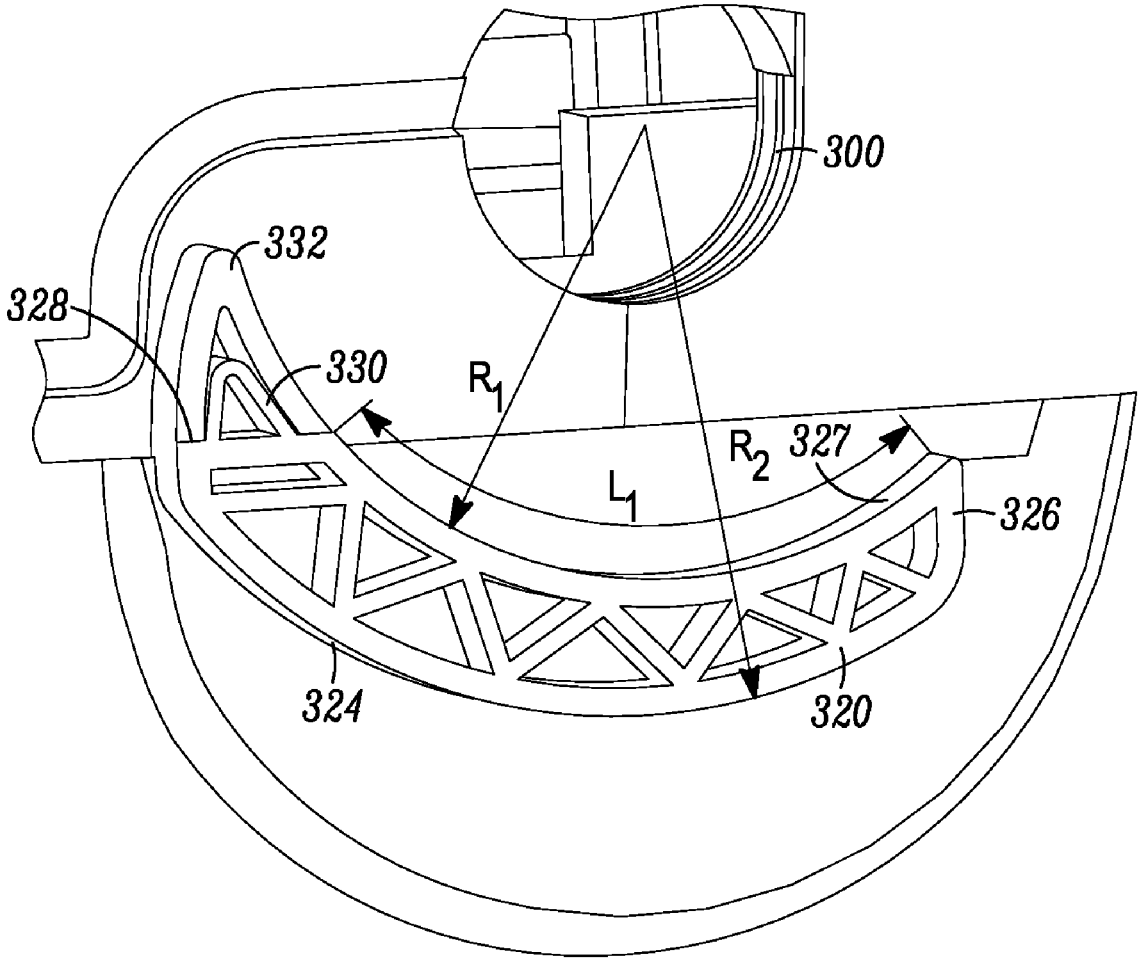
FIG. 6 is a close-up side perspective view showing details of the tank support feature of the quick connection feature.
Figure 9:
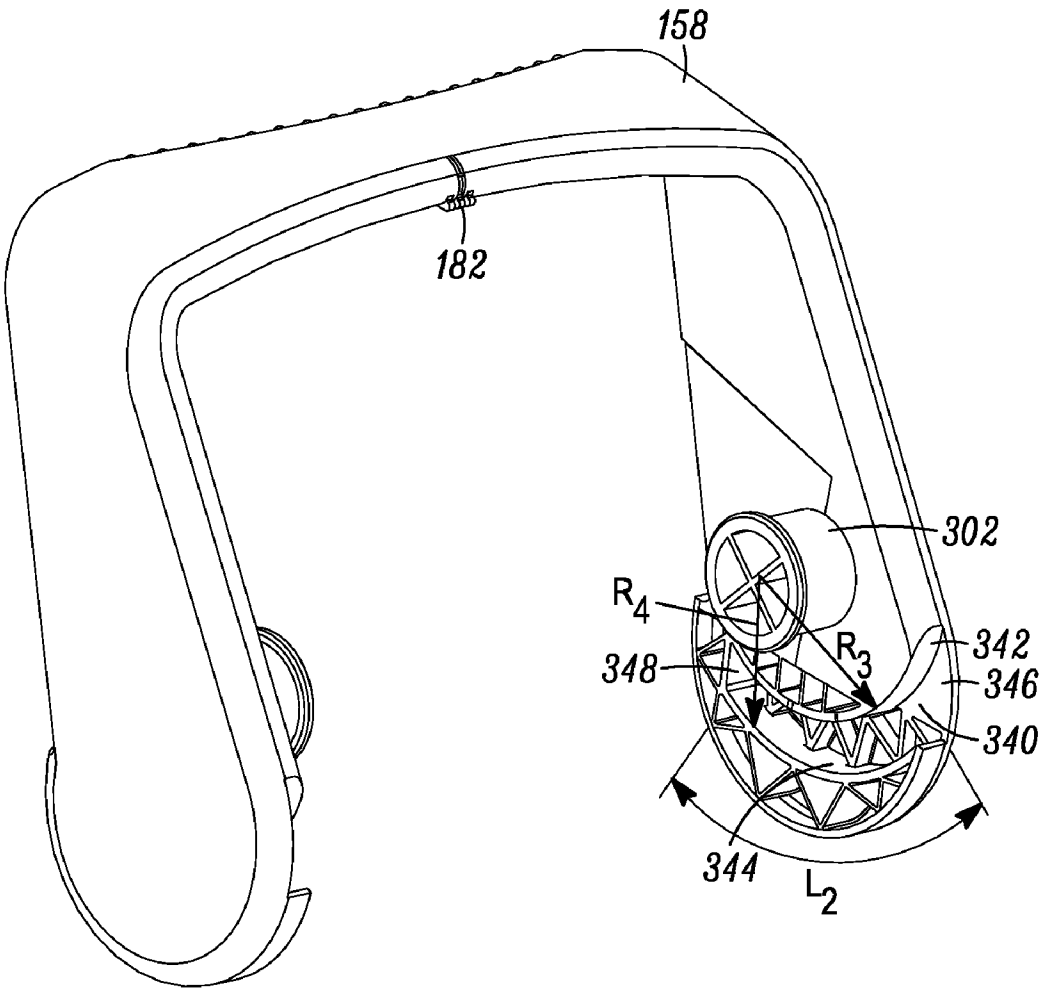
FIG. 9 is a perspective view of the handle of the humidifier of FIG. 4.

As discussed above, the position of handle 158 controls the connection of the open top container 156 to the main structure 150. Handle 158 generally rotates about an axis of rotation that is defined by a pair of pivot points on each side of the humidifier. FIGS. 5 and 6 depict an embodiment of pivot points 300 for handle 158. Only one side is shown in FIGS. 5 and 6; the other side is generally a mirror image of the depicted features. Pivot points 300 are located on, or are structurally linked to, main structure 150. As seen in FIG. 9, handle 158 has corresponding pivot points 302 that are configured to engage pivot points 300. A variety of configurations are usable for pivot points 300, 302. As shown in FIGS. 5 and 9, in one embodiment pivot points 300 are cylindrical openings and pivot points 302 are cylindrical protrusions. In another embodiment, pivot points 300 are protrusions and pivot points 302 are openings. There is generally one pivot point 300 and one pivot point 302 associated with one side of the humidifier and another pivot point 300 and pivot point 302 associated with the other side of the humidifier. Together, these features define an axis of rotation of the handle 158 about the main structure 150.

Handle 158 controls the connection of the open top container 156 to the main structure 150 by way of support features that are present at least on the open top container 156 and handle 158. An example embodiment of the support features on open top container 156 is shown in FIG. 5 and an example embodiment of the support features on handle 158 is shown in FIG. 9. Only one side is shown in FIGS. 5 and 9; the other side is generally a mirror image of the depicted features. As seen in FIG. 5, the support feature on the open top container 156 is an arc-shaped protrusion 320. Arc-shaped protrusion 320 is generally defined by a radius $R_1$ having a center near, but generally not the same as, the axis of rotation of the handle as defined by the pivot point 300. Radius $R_1$ defines a first surface 322 of protrusion 320. A radius $R_2$ also has a center near but generally not at the axis of rotation of the handle as defined by the pivot points 300. Radius $R_2$ defines a second surface 324 of protrusion 320. By virtue of the radii $R_1$ and $R_2$ not having the same center as the axis of rotation of the handle, then as the handle is rotated a cam action will occur tending to cause protrusion 320 to be drawn upward toward pivot point 300. The radii $R_1$, $R_2$ need not be exactly constant along the length of the arc-shaped protrusion 320, but instead may be slightly variable. Arc shape protrusion 320 is also defined by an arc length $L_1$ that is the length from one end of the arc shaped protrusion to the other. The arc shaped protrusion 320 has a first end 326 and a second end 328.

Figure 10:
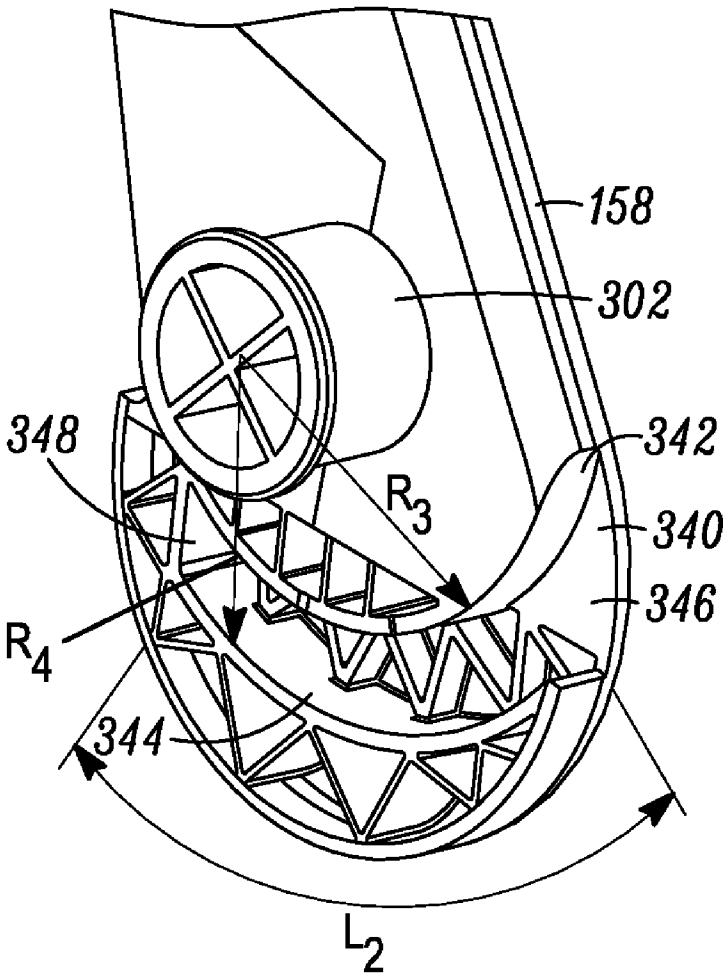
FIG. 10 is a close-up perspective view showing details of one tank support feature of the handle.

An embodiment of the corresponding support features on handle 158 is shown in FIGS. 9 and 10. The support features on the handle 158 are arc-shaped grooves 340. On each side of the handle, an arc-shaped groove 340 is defined by a radius $R_3$ having a center near but generally not at the axis of rotation of the handle as defined by the pivot point 302. Radius $R_3$ defines a first surface 342 of groove 340. In addition, a radius $R_4$ exists having its beginning at a center near but generally not at the axis of rotation of the handle as defined by the pivot point 302 and ending at a second surface 344 of groove 340. By virtue of the radii $R_3$ and $R_4$ not having the same center as the axis of rotation of the handle, then as the handle is rotated a cam action will occur tending to cause protrusion 320 to be drawn upward toward pivot point 300. The radii $R_3$, $R_4$ need not be exactly constant along the length of the arc-shaped protrusion 320, but rather may vary, and are generally similar to, or compatible with, radii $R_1$, $R_2$ of arc-shaped protrusions 320. Arc shape grooves 340 are defined by an arc length $L_2$ that is the length from the open end 346 of the arc shaped groove to the closed end 348. The length $L_2$ is generally configured to at least allow the arc shaped protrusions 320 to enter into the arc shaped grooves 340 and to allow the handle 158 to be rotated through its complete desired range of motion.

In some embodiments, an arc shaped protrusion 320 includes an alignment feature intended to promote the alignment of open top container 156 to upper structure 150. In the embodiment of FIG. 5, arc shaped protrusion 320 includes an alignment tab 330 that is a crescent- or triangular-shaped protrusion extending from second end 328. Main structure 150 includes a corresponding alignment tab receiver 332. Alignment tab receiver 332 is configured to receive alignment tab 330, and in one embodiment has a generally crescent- or triangular-shaped configuration. In use, when the user raises the open top container 156 toward the upper structure 150, alignment tab 330 will enter into alignment tab receiver 332. Because the smaller, pointed end of alignment tab 330 first enters the relatively wider opening of alignment tab receiver 332, initial alignment of the pieces is relatively easy for the user to accomplish. As the open top container 156 is raised further and becomes closer to upper structure 150, the converging walls of the alignment tab receiver 332 will force alignment tab 330 into the proper orientation, and thereby cause the open top container 156 to be correctly aligned to main structure 150.

In use, the handle 158 is manipulated by a user when the user intends to remove the open top container 156 for a reason such as to clean it. In some embodiments, the user may first perform various operations, such as providing an input to a button or a switch to indicate to the humidifier that the open top container 156 is about to be removed. This step may be useful for reasons such as allowing the humidifier controls to de-energize the heating element and to drain the water out of the tank. In some embodiments, the user may detach the water connections from the open top container 156, such as the water supply and water drain connections. When the open top container 156 is ready to be removed, the user first presses locking button 164 while simultaneously rotating handle 158 forward, toward the front of the humidifier. This action can be performed with one hand of the user because of the proximity of the locking button 164 to the handle 158. Simultaneously, the user supports the open top container 156 with his or her other hand.

As the locking button 164 is pressed down, it clears the handle 158 and allows the handle to be rotated forward. The handle rotates around pivot points 300, 302, and in doing so, causes the arc shaped grooves 340 to rotate relative to the open top container 156 and the arc-shaped projections 324 thereon. This relative rotation causes the arc-shaped projections 324 to become disengaged from the arc shaped grooves 340 upon sufficient rotation of handle 158. When arc-shaped projections 324 are disengaged from arc shaped grooves 340, the mechanical support of open top container from main structure 150, through pivot points 300, 302, to handle 158, and to arc-shaped grooves 340 and arc-shaped projections 324 is broken. The open top container 156 can now be removed from main structure 150. The open top container 156 is shown removed from main structure 150 in FIG. 13.

When it is desired to reinstall open top container to main structure 150, the user positions handle 158 in a forward position, such as the position where it was left when the open top container 156 was disengaged, and then raises open top container 156 toward main structure 150. The user generally aligns alignment tab 330 with alignment tab receiver 332, such that the projection of alignment tab 330 enters into alignment tab receiver 332 and brings open top container 156 into alignment with main structure 150. The user holds open top container 156 against main structure 150 with one hand, while with the other hand rotating handle 158 toward the rear of the humidifier. In doing so, the arc-shaped grooves 340 on handle 158 are rotated into engagement with the arc shaped projections 324 on open top container 156. Handle 158 is rotated until the cam action of the arc-shaped projections 324 and the arc-shaped grooves 340 causes the open top container 156 to be drawn tightly against main structure 150, at which point locking button 164 locks it in place, thereby securing open top container 156 to main structure 150 by way of arc shaped projections 324 and arc shaped grooves 340, pivot points 300, 302, and handle 158.

Various components of the present invention are advantageously formed by injection molding. For example, open top container 156, handle 158, and main structure 150 may be formed by injection molding. Injection molding allows the various features, including support features, such as arc-shaped protrusion of open top container 156, or arc-shaped grooves 340 of handle 158, or pivot points 300 of main structure 150, to be formed integrally and in a single step with the formation of the base component.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

The above specification provides a complete description of the structure and use of the invention. Since many of the embodiments of the invention can be made without parting from the spirit and scope of the invention, the invention resides in the claims.

What is claimed is:

1. A steam humidifier comprising:

(i) a removable tank, the removable tank configured to contain water to be heated to generate steam, the removable tank is an open top container that is configured to mate with an upper structure to form a watertight enclosure; and (ii) a handle configured to selectively secure the removable tank to the humidifier, the handle having at least:

(a) a first rotational position in which a tank support feature on the tank is engaged with a handle support feature on the handle such that the tank is attached to the humidifier, and (b) a second rotational position in which the tank support feature is disengaged from the handle support feature such that the tank is unattached from the humidifier.

2. The steam humidifier of claim 1, where the upper structure is secured to a building structure.

3. The steam humidifier of claim 2, where the handle rotates on a pair of pivot points.

4. The steam humidifier of claim 3, where the pivot points are supported by the upper structure.

5. The steam humidifier of claim 1, where the tank support feature includes an arc-shaped protrusion and the handle support feature includes an arc-shaped groove.

6. The steam humidifier of claim 5, where the upper structure includes an alignment tab configured to align the open top container to the upper structure.

7. The steam humidifier of claim 6, where a portion of the arc-shaped protrusion of the tank extends into the alignment tab.

8. The steam humidifier of claim 1, further comprising a handle locking tab configured to secure the handle in the first rotational position to the upper structure.

9. The steam humidifier of claim 8, where the locking tab is pressed down to allow the handle to be moved to the second rotational position.

10. The steam humidifier of claim 5, where the arc-shaped protrusion and the arc-shaped groove are configured to create a cam action to secure the tank to the humidifier.

11. A steam humidifier comprising:

(i) a main structure configured to be attached to a building structure;

(ii) a tank for containing water and a heating element for heating the water in the tank to generate steam, the tank comprising:

(a) an upper structure secured to the main structure;

(b) a lower structure configured to mate with the upper structure to form an enclosed volume of the tank;

(c) a pair of tank pivot points located on the upper structure; and a pair of tank arc structures on the lower structure, each tank arc structure proximate each pivot point; and (iii) a handle having a pair of handle pivot points configured to engage the tank pivot points and having a pair of handle arc structures configured to be engageable with the tank arc structures, the handle having at least:

(a) a first rotational position in which the handle arc structures are engaged with the tank arc structures such that the tank lower structure is supported by the main structure; and (b) a second rotational position in which the handle arc structures are disengaged from the tank arc structures such that the tank lower structure is free from the main structure.

12. The steam humidifier of claim 11, where the tank arc structures project from the tank lower structure.

13. The steam humidifier of claim 12, where the handle arc structures are grooves configured to receive the tank arc structures.

14. The steam humidifier of claim 11, further comprising a handle locking tab configured to secure the handle in the first rotational position.

15. The steam humidifier of claim 14, where the locking tab is pressed down to allow the handle to be moved to the second rotational position.

16. The steam humidifier of claim 14, where the handle locking tab secures the handle to the upper structure when the handle is in the first rotational position.

17. The steam humidifier of claim 11, where the tank arc structures are formed integrally with the lower structure of the tank.

18. A method of removing an open top tank from a steam humidifier, the steam humidifier structured so that the open top tank and an upper structure mate to form a watertight enclosure, the method comprising:

(i) rotating a handle from a first position to a second position, where (a) in the first position, a support feature on the tank is engaged with a support feature on the handle such that the tank is attached to the upper structure of the steam humidifier; and (b) in the second position, the support feature on the tank is disengaged from the support feature on the handle such that the tank is unattached from the upper structure of the steam humidifier; and (ii) downwardly separating the tank from the humidifier with the handle in the second position.

19. The method of claim 18, further comprising pressing a locking tab prior to rotating the handle.

20. The method of claim 18, further comprising the step of reinstalling the tank to the steam humidifier, the step of reinstalling the tank including aligning an alignment tab on the tank with an alignment feature on the steam humidifier and then rotating the handle from the second position to the first position.

21. The method of claim 19, where pressing the locking tab and rotating the handle can be accomplished with one hand of a person.

* * * * *